US006508024B1

(12) United States Patent
Hale

(10) Patent No.: US 6,508,024 B1
(45) Date of Patent: Jan. 21, 2003

(54) ROADWAY SIGN

(76) Inventor: Kevin L. Hale, 116 W. Cole St., Swayzee, IN (US) 46986

( * ) Notice: Subject to any disclaimer, the term of this patent is extended or adjusted under 35 U.S.C. 154(b) by 0 days.

(21) Appl. No.: 09/650,872

(22) Filed: Aug. 30, 2000

(51) Int. Cl.[7] ..... G09F 15/00

(52) U.S. Cl. ..... 40/624; 40/606; 40/607; 40/612

(58) Field of Search ..... 40/606, 607, 612, 40/624

(56) References Cited

U.S. PATENT DOCUMENTS

| | | | | | |
|---|---|---|---|---|---|
| 1,781,558 | A | * | 11/1930 | Speck | 40/624 |
| 3,396,483 | A | * | 8/1968 | Stein et al. | 40/607 |
| 4,007,552 | A | * | 2/1977 | Brooks | 40/606 |
| 4,317,302 | A | * | 3/1982 | Von De Linde | 40/549 |
| 4,492,049 | A | * | 1/1985 | Gaylor | 40/624 |
| 4,674,213 | A | * | 6/1987 | Keithley | 160/371 |
| 5,517,393 | A | * | 5/1996 | Townsend, Jr. et al. | 40/624 X |
| 5,542,203 | A | * | 8/1996 | Luoma et al. | 40/612 X |
| 6,044,595 | A | * | 4/2000 | Snow | 52/101 |
| 6,230,427 | B1 | * | 5/2001 | McDaniel | 40/624 |

* cited by examiner

*Primary Examiner*—Eric K. Nicholson
*Assistant Examiner*—James M. Hewitt
(74) *Attorney, Agent, or Firm*—Krieg DeVault Lundy, LLP

(57) ABSTRACT

A new and improved highway sign or billboard advertising structure having a vertical support post on which a sign face support structure is mounted. Each of these sign face support structures has a scaffold mounted adjacent the bottom of the sign face extending inwardly toward the support. A housing encompasses the entire sign face support structure. The housing has openings therein through which the sign faces may be viewed. The housing being environmentally sealed to exclude birds, rodents and insects from the enclosed space between opposite sign faces surrounding the multiple scaffoldings.

38 Claims, 17 Drawing Sheets

ROADWAY SIGN

BACKGROUND OF THE INVENTION

The present invention relates to a new and improved roadway sign or billboard advertising structure, and more particularly to a fully enclosed roadway sign billboard construction which allows for maintenance in inclement weather and with improved safety to the maintenance crews.

Roadway signs and billboards have been a part of the advertising industry for over 80 years. Modern day billboard construction includes either single or double sided signs and a wooden or steel monopole super structure or multiple back to back signs in either a rectangular format, single level, double or tri-level or a triangular format, single level, double level or tri-level.

The conventional roadway and billboard advertising structures each are exposed to the weather, thereby causing maintenance crews to bear the weather while maintaining the signs, provide nesting areas for a variety of birds and rodents, and are almost always elevated from the ground whereby maintenance crew injuries are experienced annually by falls from scaffolds, ladders and the like. It is therefore highly desirable to provide a safer, new and improved roadway and billboard advertising structure. It is also highly desirable to provide a new and improved roadway and billboard sign construction that is enclosed providing no bird, rodent and insect nesting areas. It is also highly desirable to provide a new and improved enclosed roadway and billboard sign construction by which the service personnel are safe and completely isolated from weather conditions such that a sign can be safely maintained in all weather conditions.

Additionally, these roadway and billboard advertising structures may have changeable screens either utilizing Trivision technology or pivotal sign faces by which signs can be changed while the sign on the reverse face is viewed. It is therefore highly desirable to provide a new and improved roadway sign having changeable sign faces. It is also highly desirable to provide a new and improved roadway sign in which the working conditions of the service personnel can be relatively clean, safe, comfortable and protected from the environment. It is further highly desirable to provide a new and improved roadway sign in which the service personnel are not subjected to stinging insects, diving birds or other distractions while maintaining the sign minimizing injury and falls from the scaffold. Finally, it is highly desirable to provide a new and improved roadway and billboard advertising structure having all of the above features.

SUMMARY OF THE INVENTION

It is therefore an object of the invention to provide a new and improved roadway and billboard advertising structure.

It is also an object of the invention to provide a new and improved roadway and billboard advertising structure construction that is enclosed providing no bird, rodent and insect nesting area.

It is also an object of the invention to provide a new and improved enclosed roadway and billboard advertising structure construction by which the service personnel are completely isolated from weather conditions such that a sign can be safely maintained in all weather conditions.

It is also an object of the invention to provide a new and improved roadway sign having changeable sign faces.

It is also an object of the invention to provide a new and improved roadway sign in which the working conditions of the service personnel can be relatively clean, safe, comfortable and protected from the environment.

It is also an object of the invention to provide a new and improved roadway sign in which the service personnel are not subjected to stinging insects, diving birds or other distractions while maintaining the sign causing injury or falls from the scaffold. It is finally an object of the invention to provide a new and improved roadway and billboard advertising structure having all of the above features.

In the broader aspects of the invention there is provided a new and improved highway sign or billboard advertising structure having a vertical support post on which a sign face support structure is mounted. Each of these sign face support structures has a scaffold mounted adjacent the bottom of the sign face extending inwardly toward the support. A housing encompasses the entire sign face support structure. The housing has openings therein through which the sign faces may be viewed. The housing being environmentally sealed to exclude birds, rodents and insects from the enclosed space between opposite sign faces surrounding the multiple scaffoldings.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
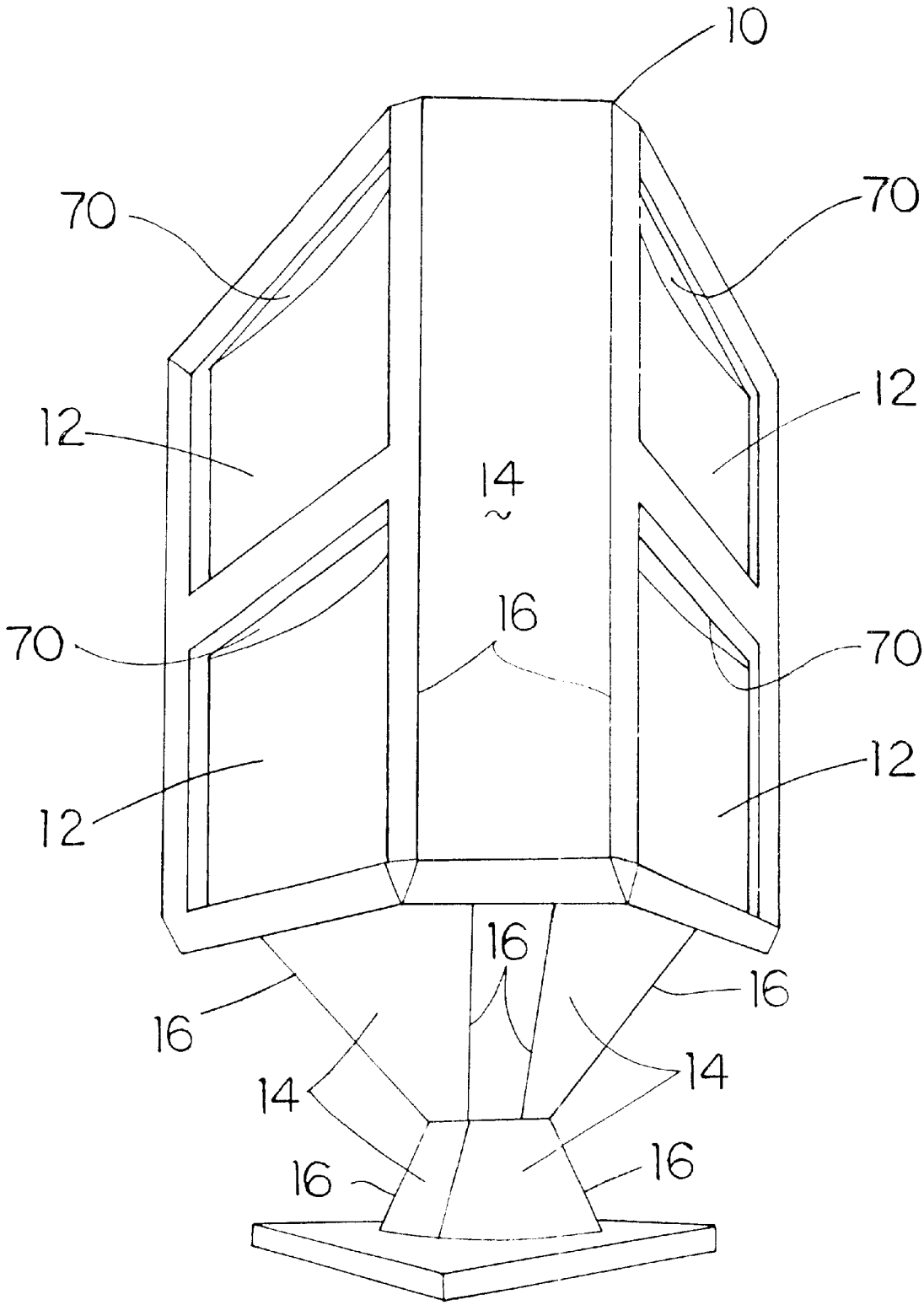
FIG. 1 is a front perspective view of the new and improved highway sign or billboard of the invention viewed from the front thereof.
Figure 2:
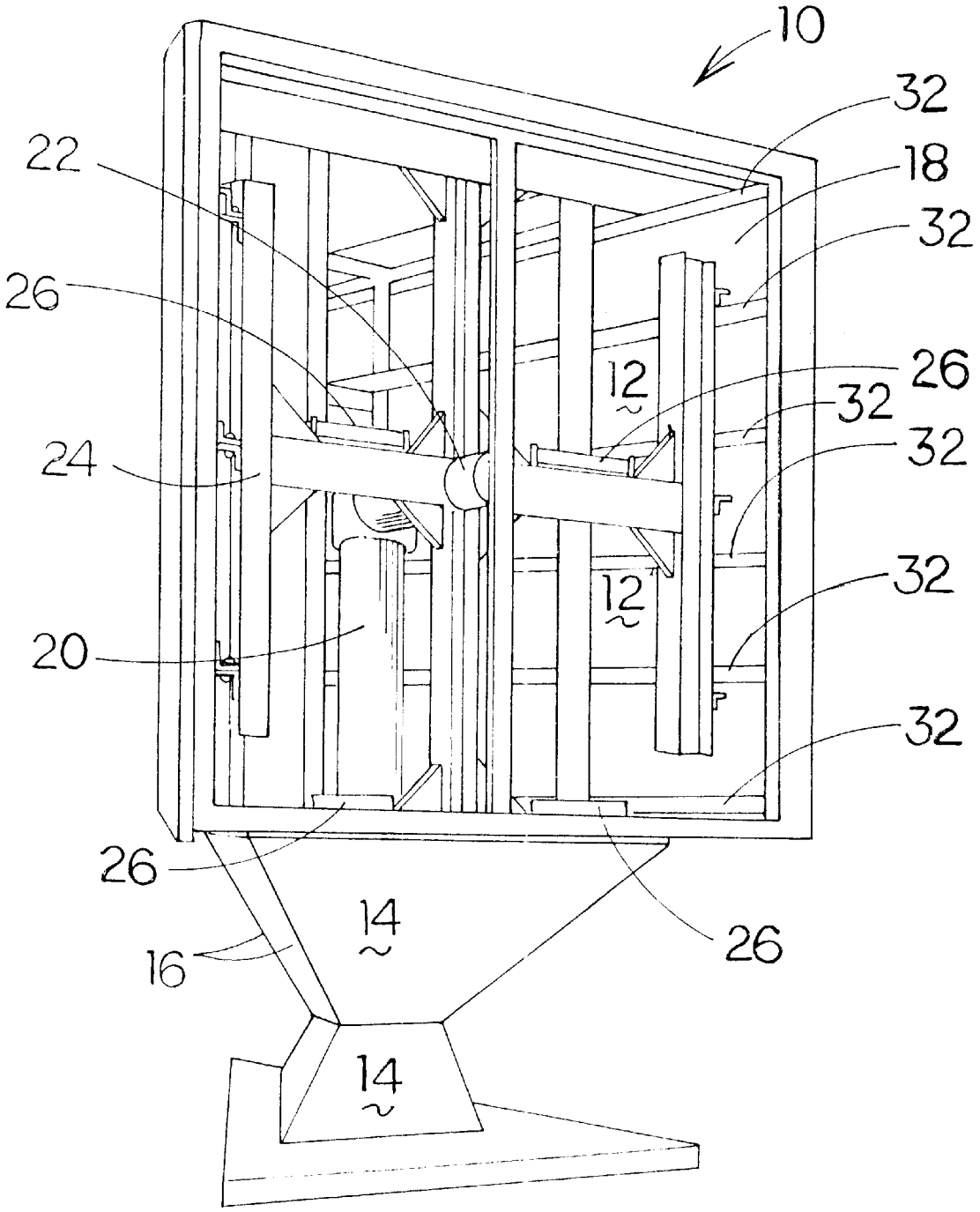
FIG. 2 is a rear perspective view of the new and improved highway sign or billboard of the invention shown in FIG. 1.
Figure 3:
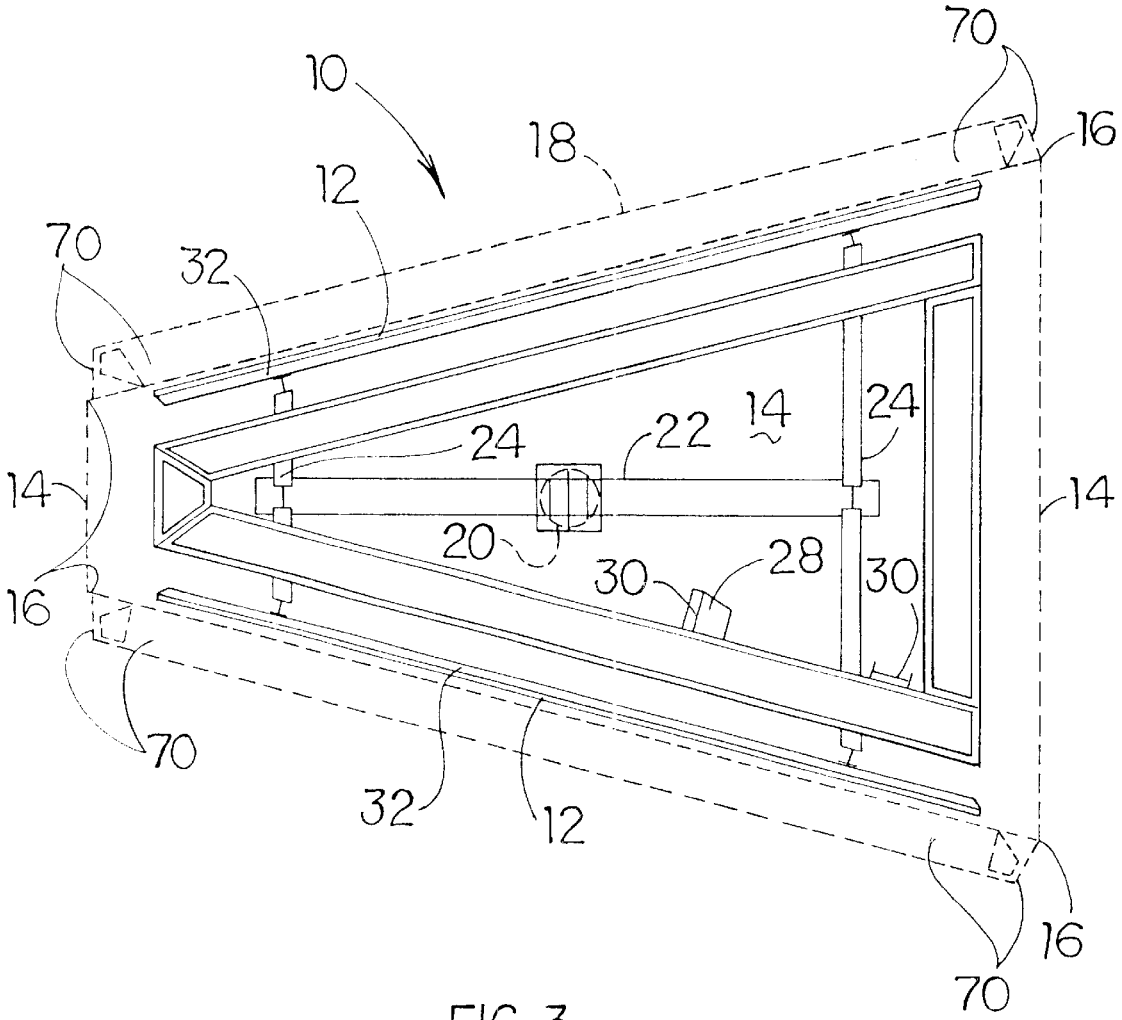
FIG. 3 is a top view thereof with the housing removed.
Figure 4:
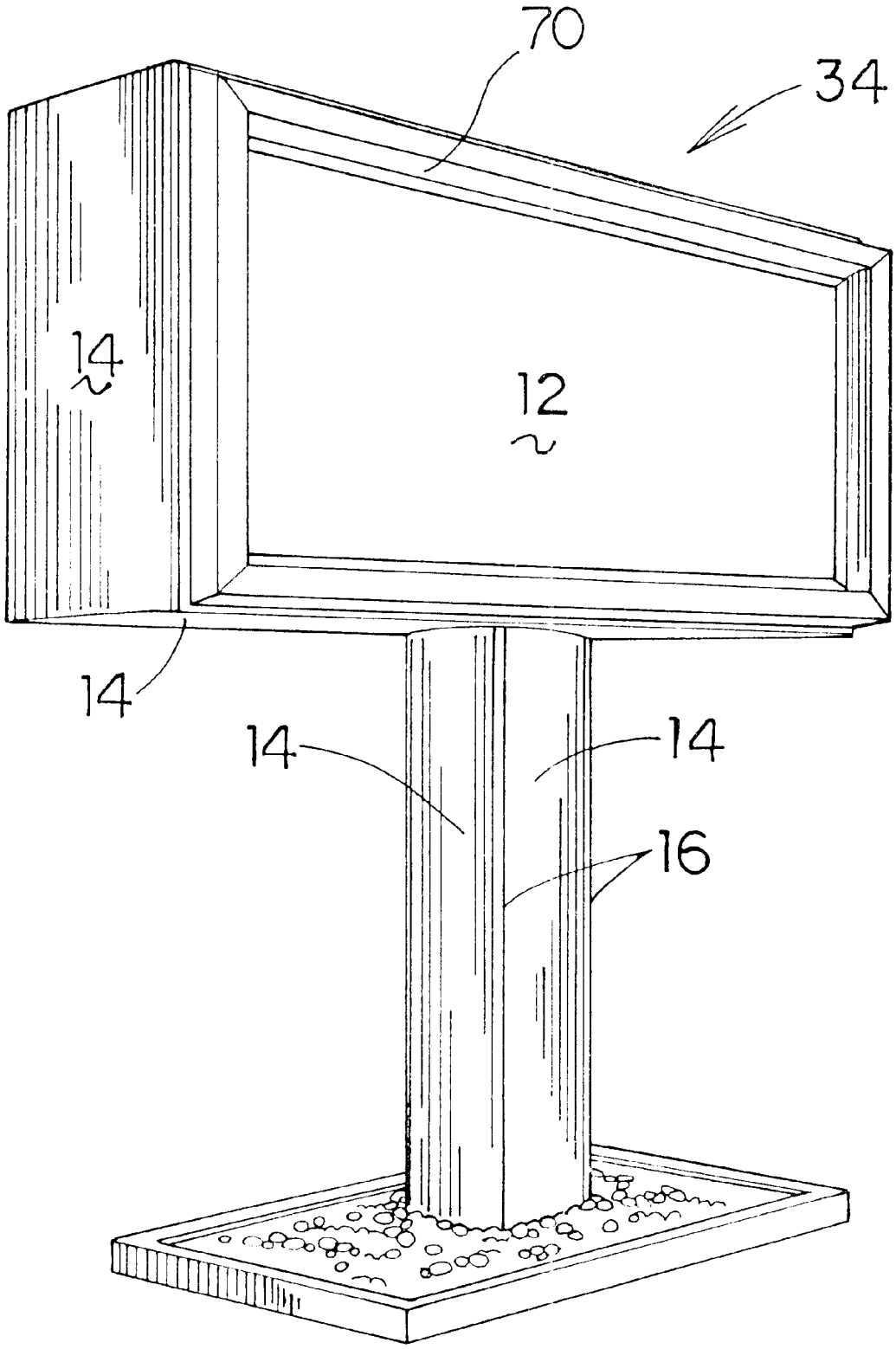
FIG. 4 is a front perspective view of a modified version of the new and improved highway sign or billboard of the invention.

FIGS. 1–3 illustrate the front perspective and a rear perspective view, respectively, of a triangular highway sign and billboard 10 of the invention. Sign 10 presents four sign panels 12 fully enclosed by exterior housing panels 14 joined together at bolted, weather-tight sealed joints 16 inside forming an enclosure 18. Inside the enclosure 18 is a vertical support pole 20 on which a torsion tube 22 is secured. Secured to the torsion tube is a structural cross member or brace 24 which supports a scaffold for each sign panel 12. Each scaffold has upper and lower catwalks 26 which are reached by a stair platform 28 and a ladder 30 (shown only in FIG. 3). The sign panels 12 are supported by a plurality of stringers 32.

Figure 5:
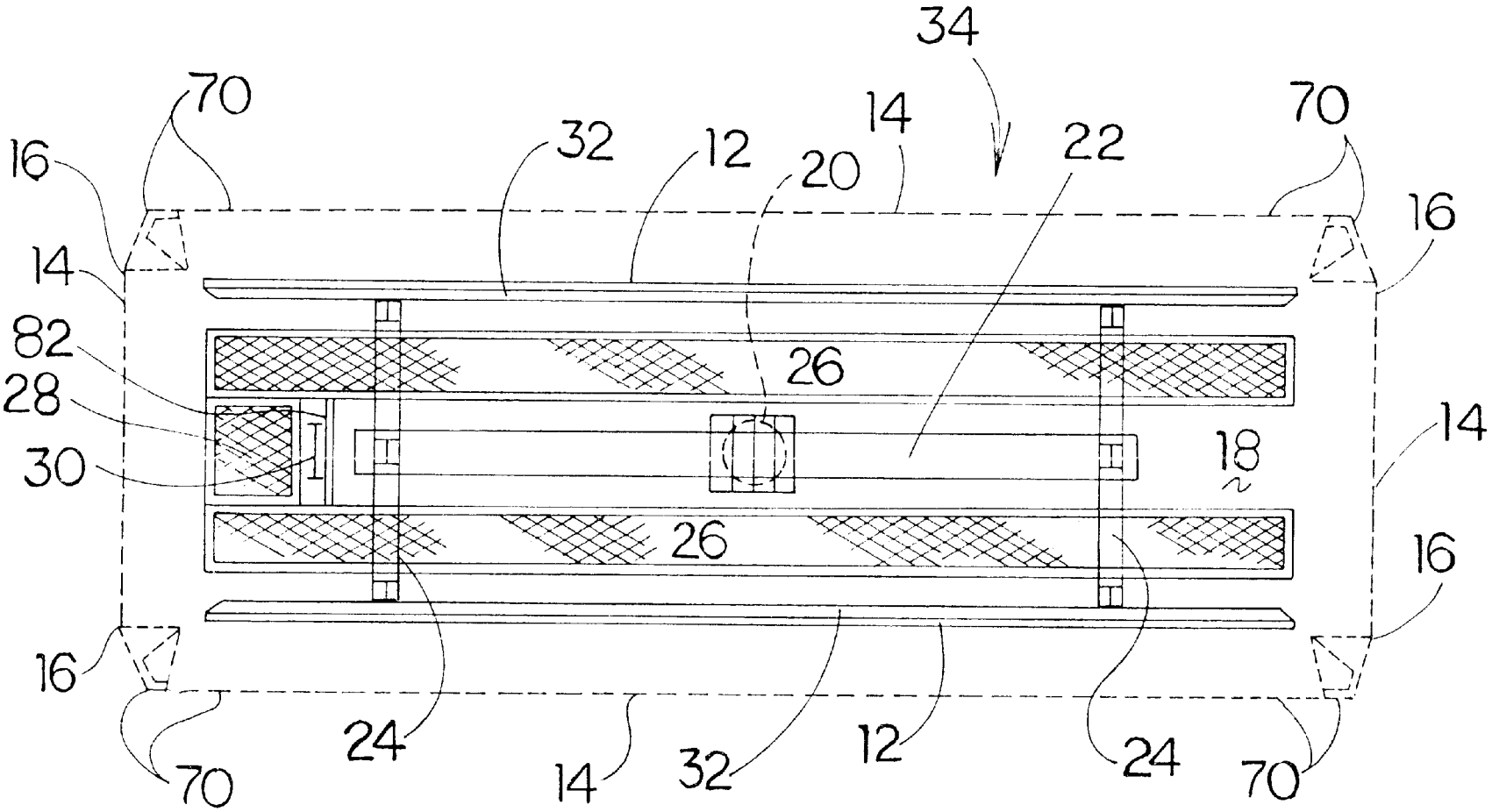
FIG. 5 is a top view thereof with the housing removed.
Figure 6:
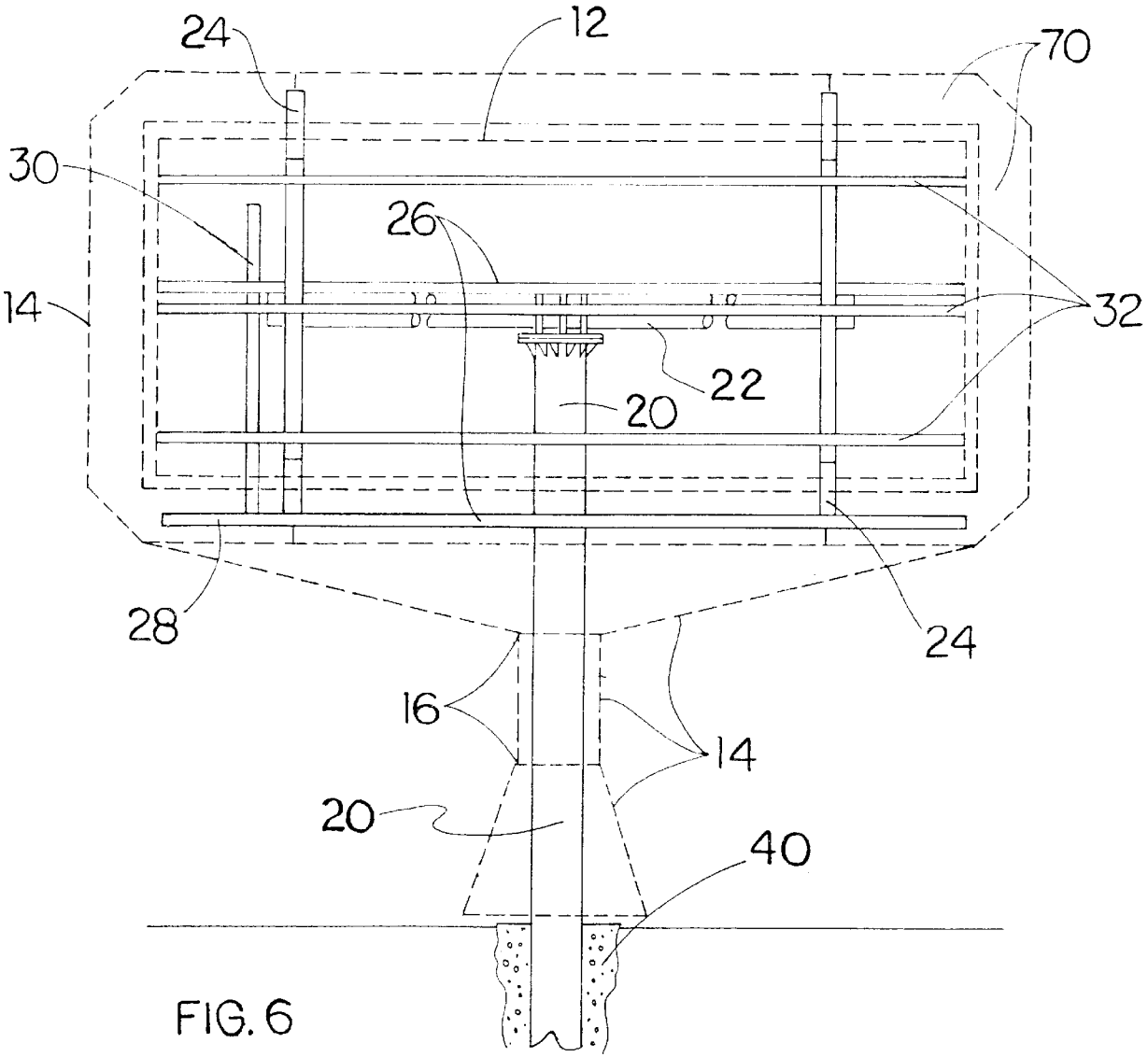
FIG. 6 is a cross-sectional view of the highway sign and billboard illustrated in FIG. 5 taken substantially along the section line 6—6 of FIG. 5.
Figure 7:
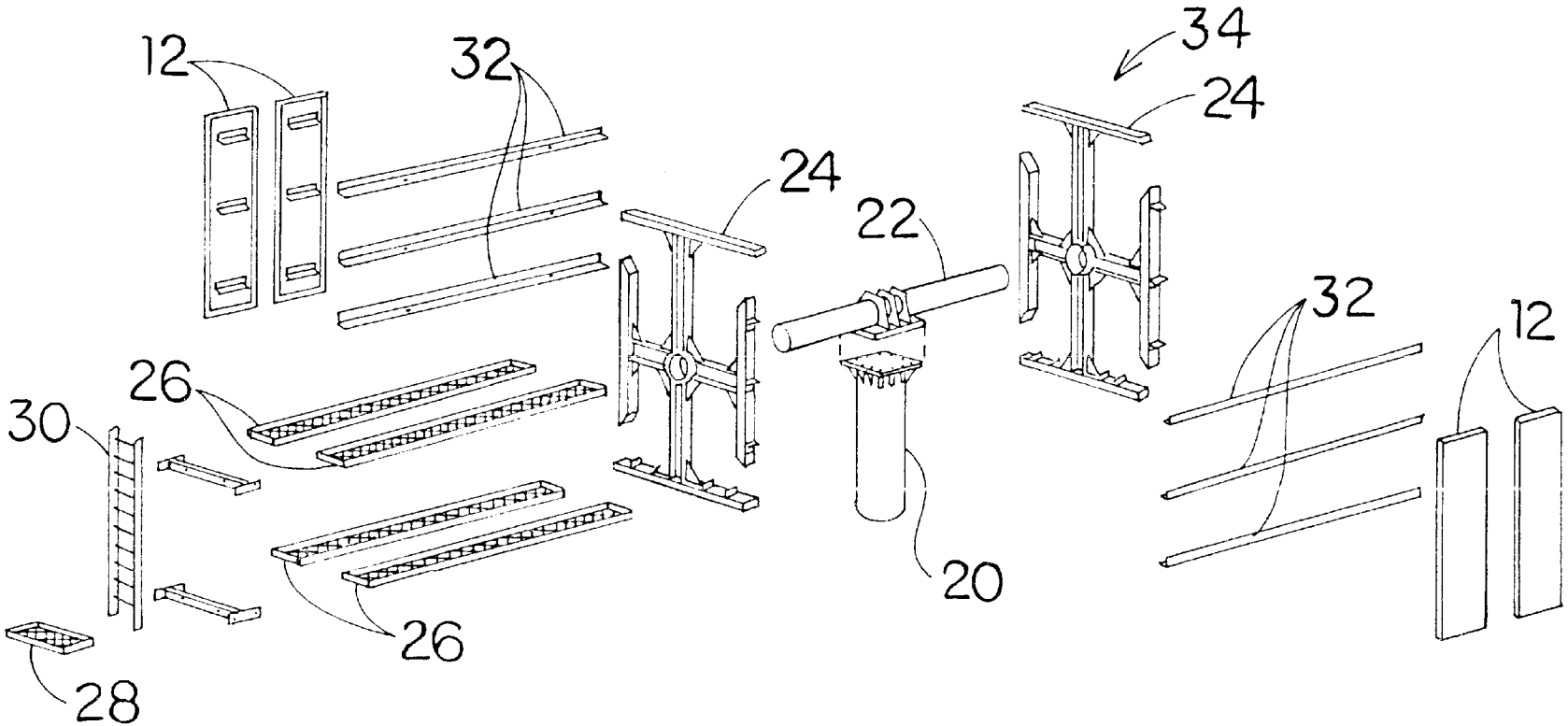
FIG. 7 is an exploded view of the highway sign and billboard illustrated in FIG. 4.

Referring now to FIGS. 4–7, there is shown a modified version 34 of the new and improved highway sign and billboard of the invention. Version 34 differs from version 10 shown in FIGS. 1–3 primarily as version 34 has only two sign panels 12 facing in opposite directions and version 10 has two pair or a total of four sign faces 12 facing in opposite directions and version 10 is generally triangular in shape, whereas version 34 has the shape of a rectangular box. Version 34 is shown in FIGS. 5–7 with all of the panels 14 of the enclosure 18 removed. Version 34 includes a vertical support pole 20, a generally horizontal torsion tube 22, two spaced apart cross members 24, two pair of catwalks 26, a platform 28 and a ladder 30, and opposite sign panels 12 secured together with a plurality of stringers 32. See especially FIG. 7.

The new and improved billboard and highway signs 10 and 34 may take several other modified versions. Version 34 may include three pair or two pair of sign faces oppositely facing as version 10. Version 34 may also have a single sign face or a single pair or three sign faces facing in the same direction as desired. Similarly, with regard to version 10, version 10 may have only a single sign face, a single pair or three pair of sign faces facing in a single direction or a single pair or multiple pairs of sign faces facing in opposite directions. The primary difference between these versions is the size of the cross member 24 and the number of horizontal members 56.

Figure 10:
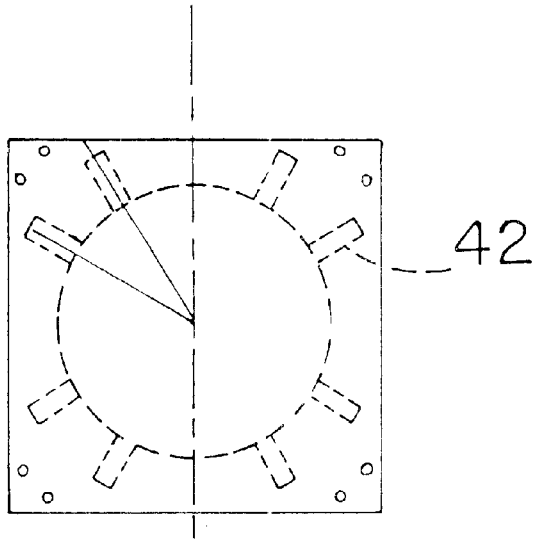
FIGS. 9 and 10 are the fragmentary side view and top view, respectively, of the mounted pole and multi-plate structure of the highway sign and billboard illustrated in FIG. 1.
Figure 9:
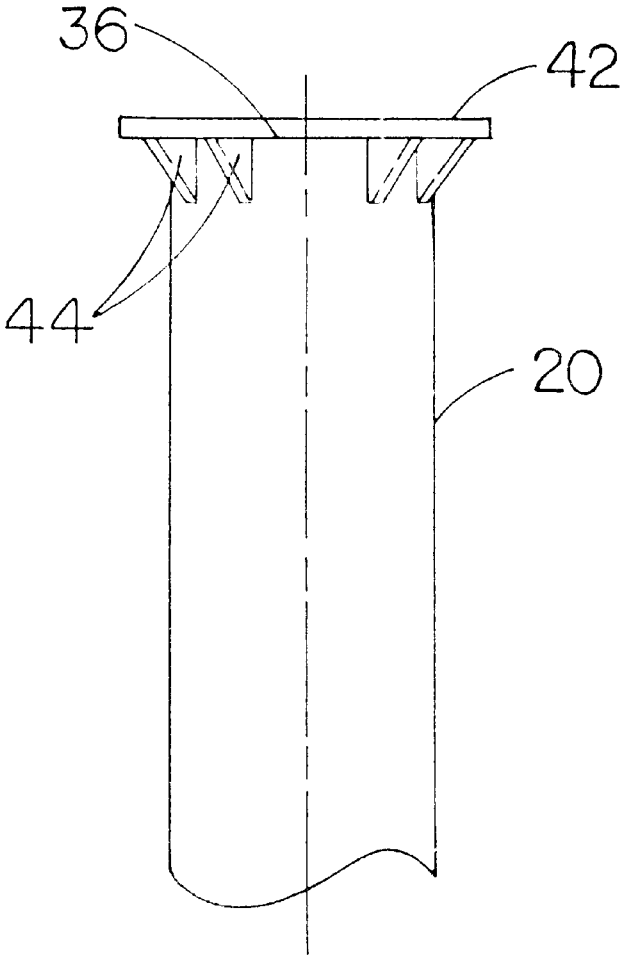

Referring to FIGS. 7, 9 and 10, the entire billboard and highway signs of the invention 10, 34 is supported on the ground by a vertical pole or post 20. Post 20 has a top end 36 and a bottom end 38. Bottom end 38 is anchored in the ground with a footing 40. Top end 36 has a mounting plate 42 secured thereto and strengthened by a plurality of gussets 44. In a specific embodiment, pole 20 may be a 20 to 40 inch diameter pipe and have a length between 20 and 40 feet long depending upon which version 10, 34 is contemplated.

Figure 13:
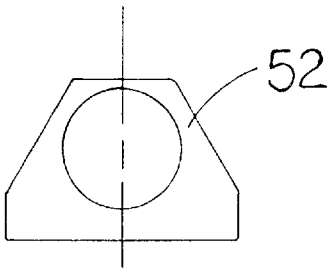
FIGS. 11, 12 and 13 are the side view, top view and end view of the torsion tube assembly of the highway sign and billboard illustrated in FIG. 1.
Figure 12:
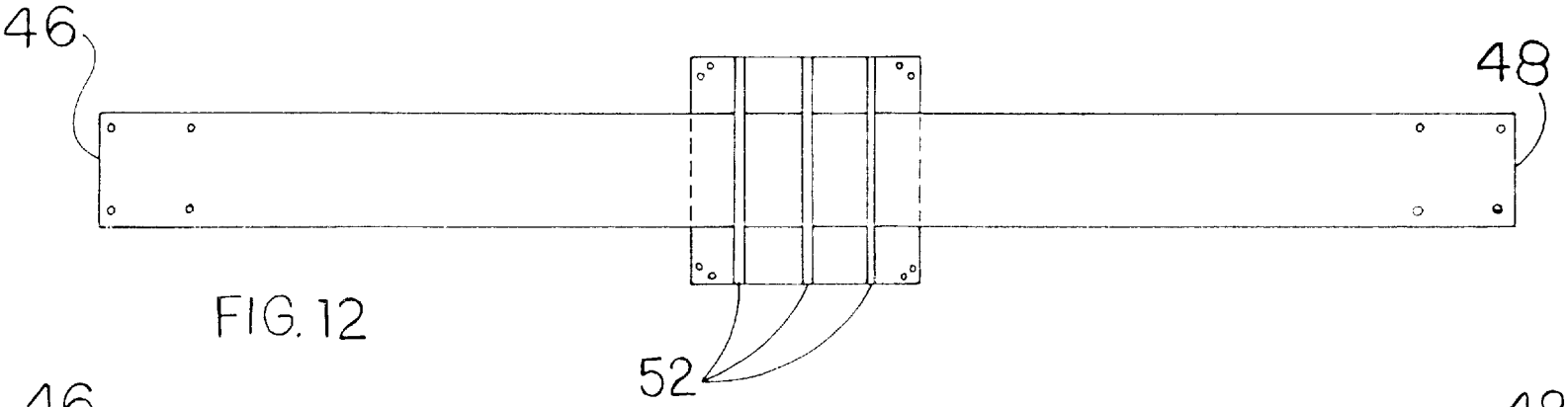
Figure 11:
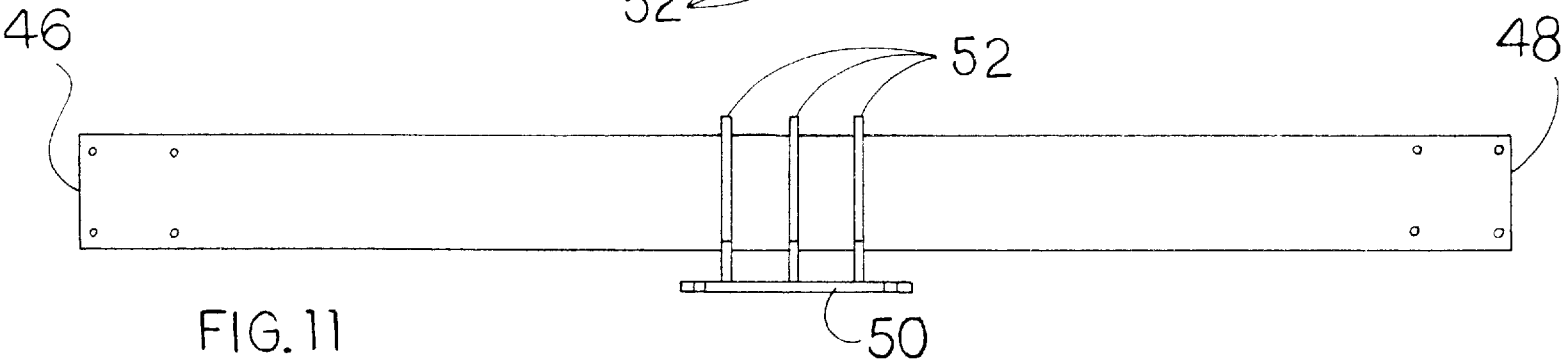

Mounted to top 36 of pipe 20, is torsion tube 22. See FIGS. 11–13. Torsion tube 22 has opposite ends 46, 48 and is secured to pipe 20 by a mounting plate 50 and a plurality of tube supports 52. Tube supports 52 are secured to mounting plate 50 in a vertical fashion and have an opening 54 extending therethrough. Torsion tube 22 is positioned within the opening 54 of the tube supports 52 and the mounting plate 50 is secured to the mounting plate 42 thereby securing torsion tube 22 to the pole 20 as specifically shown in FIGS. 2, 6, 11 and 12. In this fashion, torsion tube 22 is secured to the tube 20 with ends 46, 48 extending outwardly on opposite sides of the post or pole 20 as shown.

Figure 8:
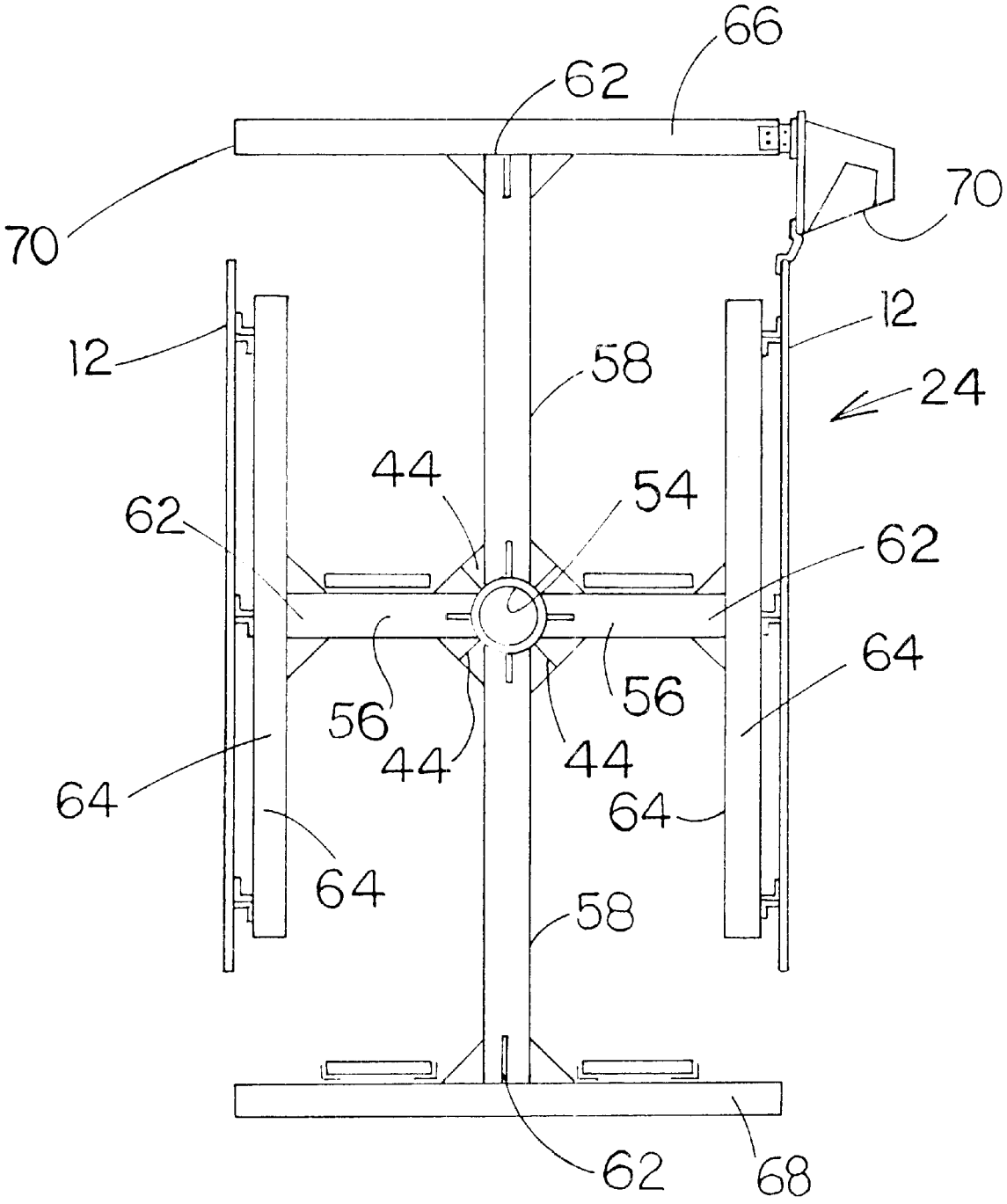
FIG. 8 is a cross-sectional view of the highway sign and billboard illustrated in FIG. 5 taken substantially along the section line 8—8 of FIG. 5.
Figure 14:
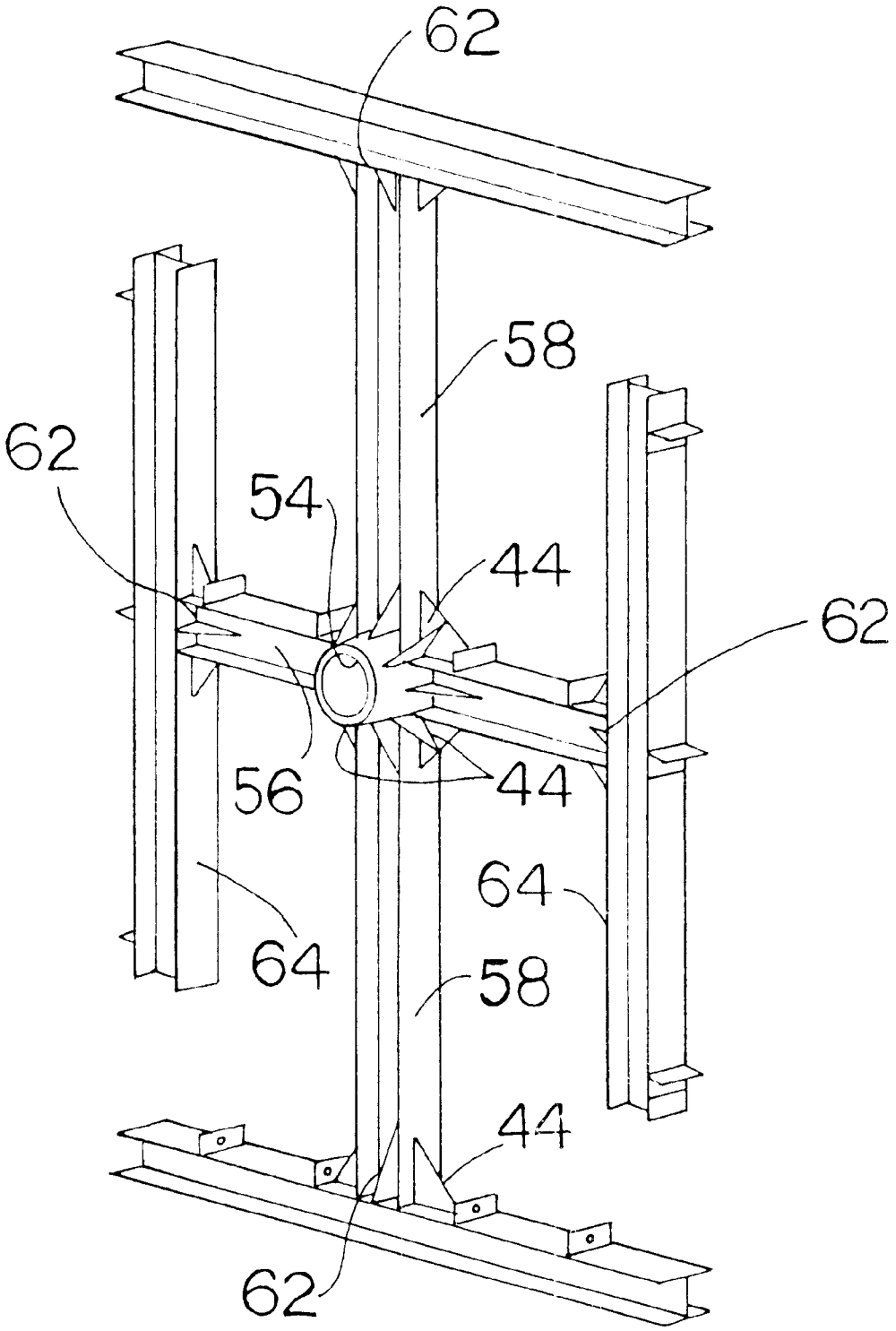
FIG. 14 is a perspective view of the new and improved structural brace of the highway sign and billboard illustrated in FIG. 1.

Referring to FIGS. 7, 8 and 14, cross member 24 is shown to have a hub 54 from which horizontal members 56 extend radially outwardly and vertical members 58 extend radially upwardly and downwardly. Both horizontal members 56 and vertical members 58 are secured by welding with gussets 44 extending between members 56, 58 and the hub 54. Each of the horizontal and vertical members 56, 58 have distal ends 62. Secured to the distal ends 62 of horizontal members 56 are vertically extending sign face support members 64. These members also have gussets 44 extending between the horizontal member 56 and vertically extending sign support member 64. Secured to the opposite ends 62 of the vertical members 58 is a top member 66 and a bottom member 68. Top member 66 and bottom member 68 also have gussets 44 extending between vertical member 58 and top member 66 and vertical member 58 and bottom member 68.

Cross member 24 as above described is the primary structural element of the new and improved highway sign and billboard 10, 34 of the invention. There is a pair of cross members 24 in version 34 and a single cross member 24 in the triangular version 10. As shown in FIGS. 7 and 8, horizontal members 56 and bottom member 68 support the four catwalks 26 of a sign face panel 14 of the highway sign and billboard of the invention. Sign support members 64 support the sign faces 12 and top member 66 supports the light and trim assembly 70.

In specific embodiments, cross member 24 has a variety of dimensions from about 24 feet square in a sign having two pair of oppositely facing sign faces 12, to a cross member being approximately 5 foot by 12 foot in a sign having a single pair of oppositely facing sign faces 12.

Figure 15:
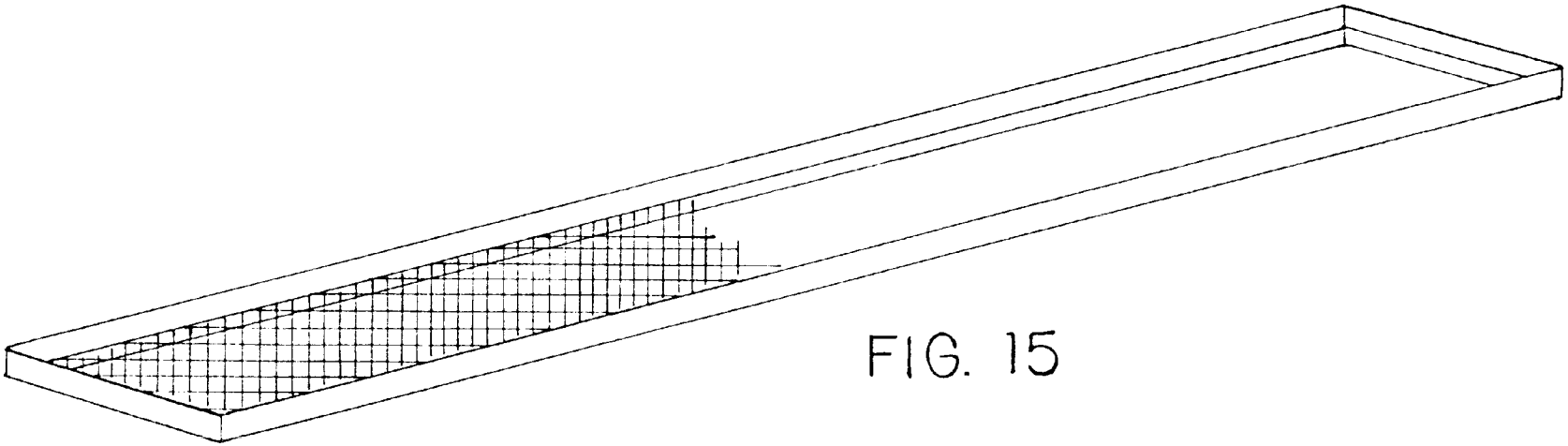
FIG. 15 is a perspective view of the catwalk construction of the highway sign and billboard illustrated in FIG. 1.

Referring now to FIG. 15, catwalks 26 are each provided with a peripheral frame 72 generally formed of angle iron. Inserted within the rectangular frame is steel grating which provides support for persons working on the sign within the new and improved highway sign and billboard of the invention. In a specific embodiment, each of the catwalks 26 may be the same and measure approximately 18 inches wide and 24 feet long.

Figure 16:
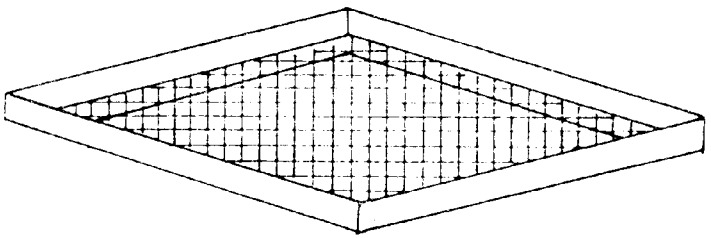
FIGS. 16, 17 and 18 are perspective views of the platform, ladder and ladder supports, respectively, of the new and improved highway sign and billboard illustrated in FIG. 1.
Figure 17:
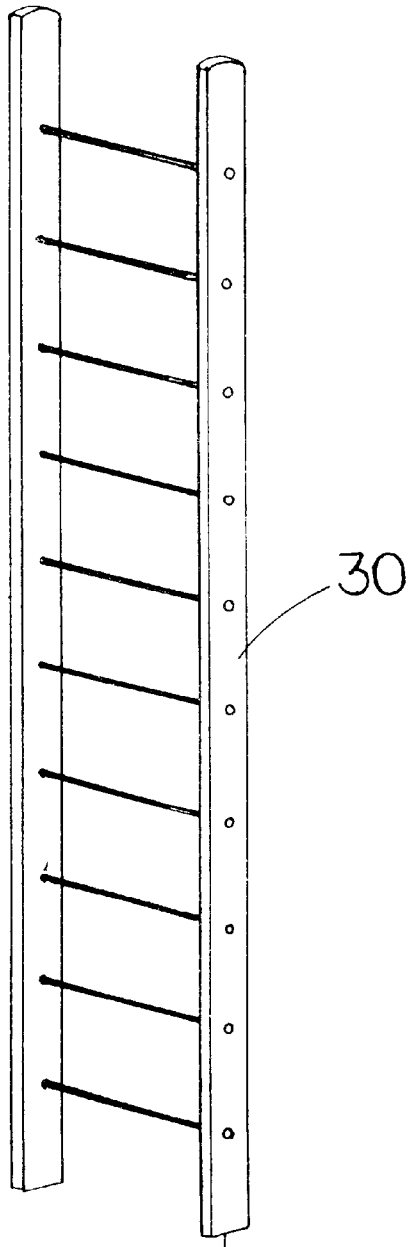
Figure 18:
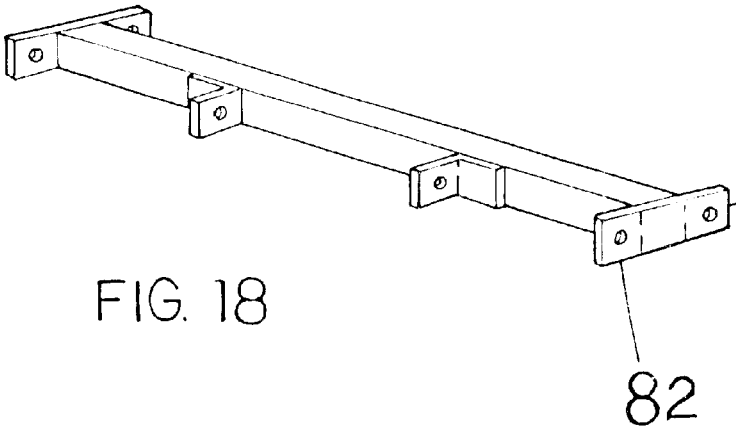

In each of the versions 10, 34 there is provided a ladder assembly 76, shown in FIGS. 16–18, by which workmen may access the upper and lower catwalks 26 of sign faces 12. The ladder platform 28 may be positioned on one end of the sign, as shown in FIG. 7, or may be centrally located as desired. The ladders 30 and the ladder bracket 82 may be secured to pole or post 20 as illustrated in FIG. 6 or to the ends of the respective catwalks 26 at one end thereof as shown in FIG. 7.

Figure 19:
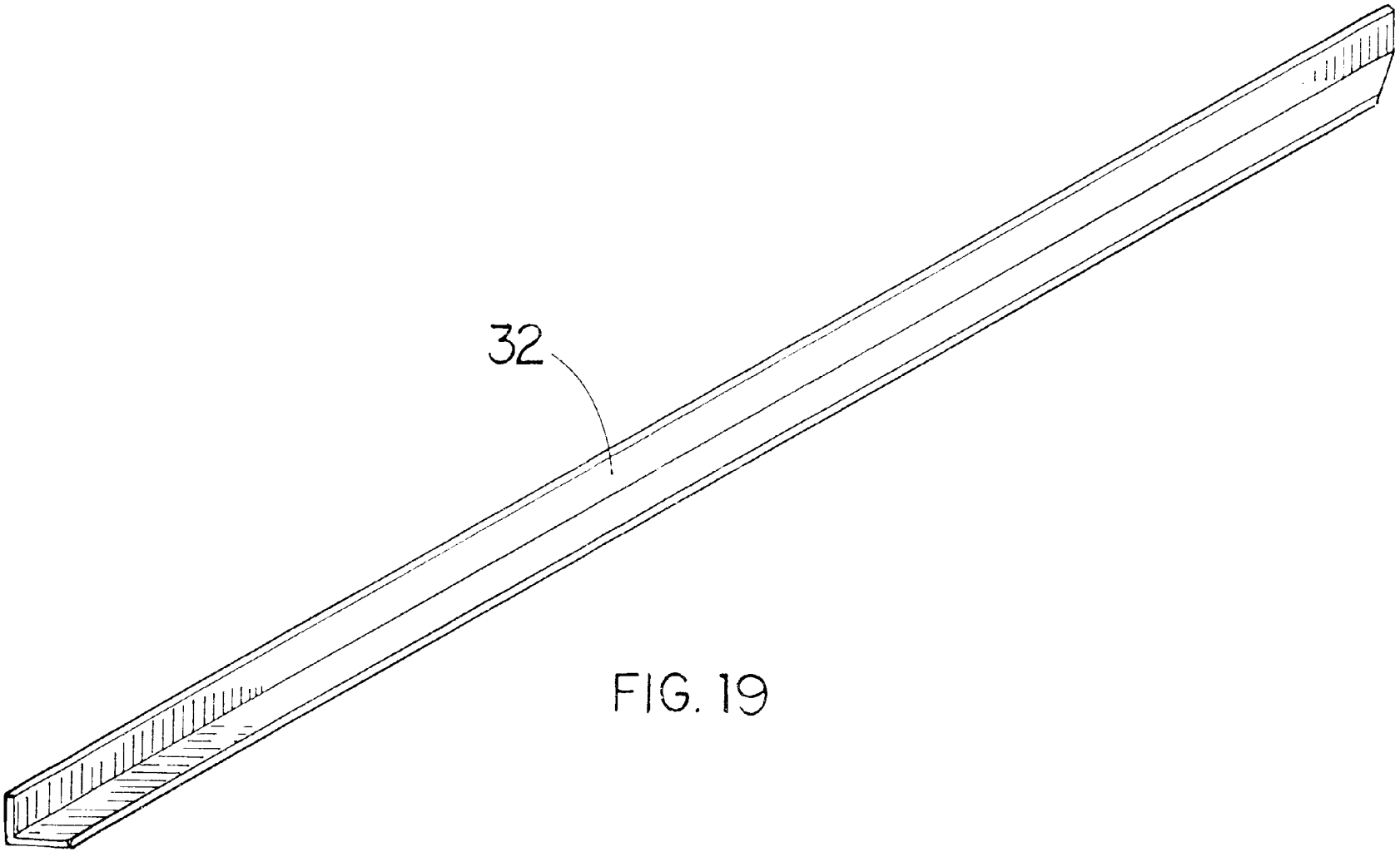
FIG. 19 is a perspective view of the face panel stringers of the new and improved highway sign and billboard illustrated in FIG. 1.

The sign faces 12 are secured to the support members 64 by a plurality of stringers 32. Each of the stringers 32 may be angle iron as shown in FIG. 19. The sign faces themselves, as shown in FIG. 7, may be vertical panels 84 or a single sheet or any number of conventional sign faces 12. These various embodiments include trivision panels, and sheets of a flexible vinyl material 89 mounted on spaced panels 12 or any other conventional sign panel.

Figure 20:
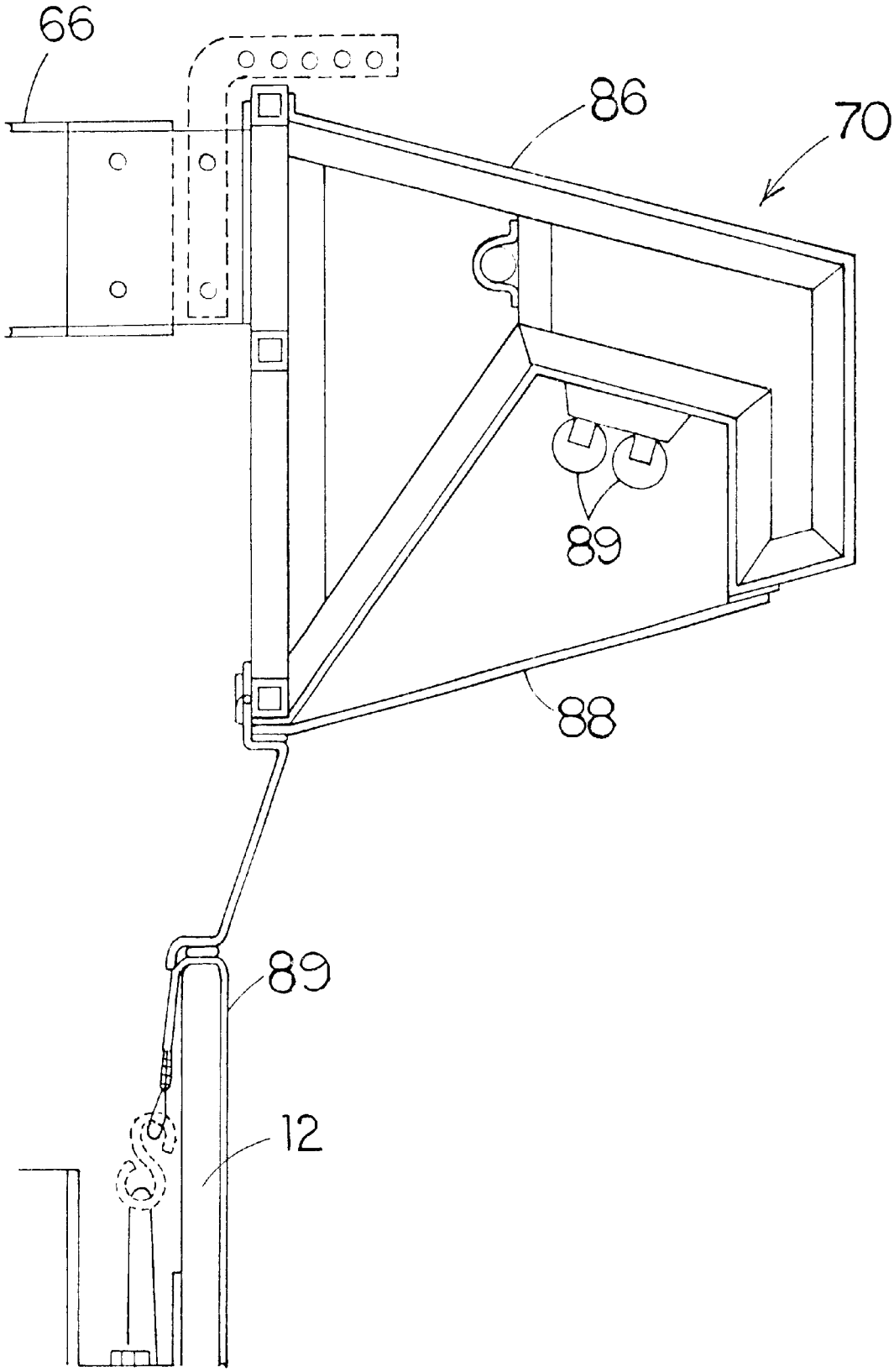
FIG. 20 is a cross-sectional view of the light and trim assembly of the new and improved highway sign and billboard illustrated in FIG. 1.

The light and trim assembly 70 shown in FIG. 8 is detailed in FIG. 20. The light and trim assembly 70 is secured to the top member 66 of the cross member 24 as shown. Light and trim assembly 70 has an enclosure 86 to which the lights are mounted and a glass or plastic cover 88 enclosing the lights 89.

Figure 21:
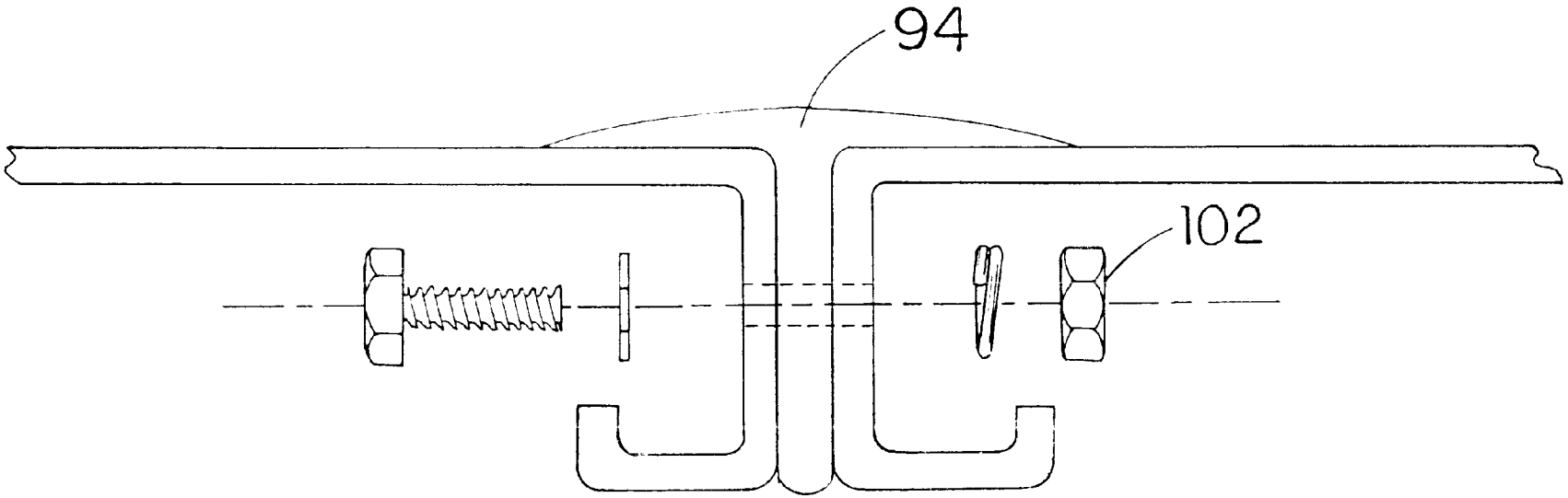
FIGS. 21 and 22 are fragmentary, cross-sectional and perspective views, respectively, of the panel joints of the new and improved highway sign and billboard illustrated in FIG. 1.
Figure 22:
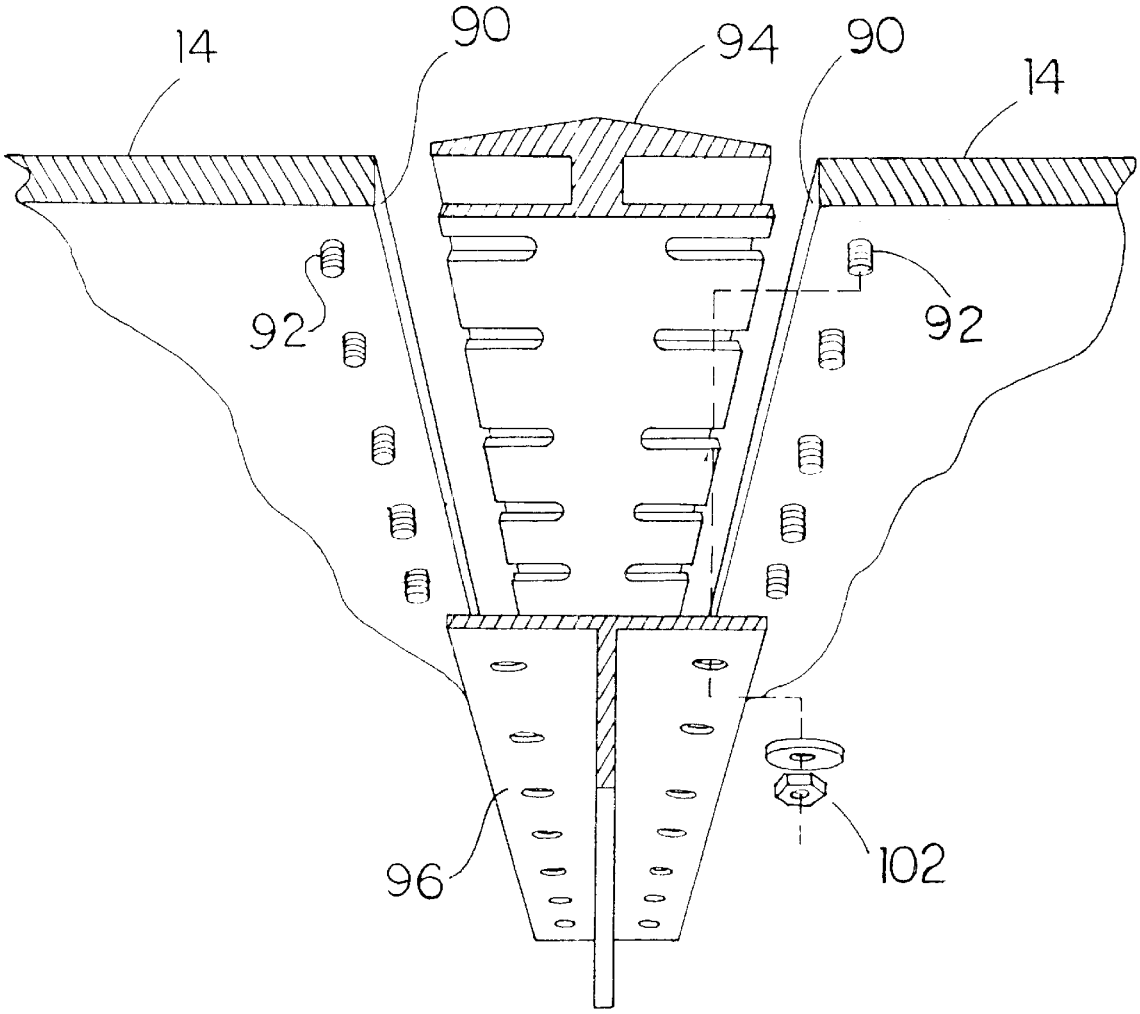

The entire sign structure as shown in FIG. 7 and as above described, is positioned within an enclosure 18 defined by a housing made of sheet metal or plastic panels 14 joined by joints 16. The joints 16 connect each panel 14 having a peripheral edge held together by tack welded studs 92, a rubber seal 94 and a T-shaped plate 96 as shown in FIG. 22 or each panel 14 is terminated at a crimped peripheral boundary 100 and has bolts 102 positioned to fasten a rubber seal between boundaries 100 as shown in FIG. 21. By either of these techniques, the housing panels 14 totally enclose all of the structure above described and in a manner in which the housing enclosure 18 is environmentally sealed, such that the housing isolates the enclosure 18 from the weather and from the natural and man-made elements, such as animals and pollution. For example, workmen working within the sign enclosure are not subjected to the weather. In a specific embodiment, a space heater or air conditioner may be placed within the enclosure to heat or cool the inside as desired.

In operation, the new and improved highway sign and billboard 10, 34 of the invention is fully enclosed by the enclosure 18 to provide no bird, rodent, or insect nesting areas. The enclosure provides service personnel with a work area which is completely isolated from weather conditions which can be maintained and relatively clean and comfortable and protected from the environment.

Workmen needing to change the sign faces 12 merely mount the sign, utilizing ladders 30 to access the catwalks 26. Each catwalk 26 provides full access to the sign from the rear of sign face 12. Enclosure 18 completely protects the workmen. In a specific embodiment, the enclosure may be provided with lighting and heat as is desired. By enclosing the structure in which they work, service personnel will no longer be exposed to the hazards or health risks associated with the conventional billboard advertising structures.

Conventional signage utilizes painted signs, vinyl sheets with signs already applied, paper sticky back signs which can be applied like a decal, and other improvisations including removable vinyl graphics, sheet wraps and vertical squares. Both Trivision technology and conventional signs mounted on vinyl panels extend between two spaced apart rollers and allow the signage to be changed from the opposite side of panel 12. Other improved technology would include moveable message technology, back lighting, and interactive signs. Moveable message technology is now available in which panels in the form of vertically or horizontally extended elements having opposite sides, a triangular cross-section having three sides are positioned side by side to display two or three different messages on one sign structure, respectively. Back lighted, translucent, flexible vinyl sheet bring depth, color and density to the night time images. Interactive billboards are also now being used whereby toll free phone numbers and short wave radio stations entice the viewer to immediately seek out more product information.

Sign panels 14 may be changed or maintained by persons standing on the scaffold or catwalks 26. The sections of sign panels 12 are moved to place the exterior surface of the sign panel 12 facing the interior long enough for the new sign to be positioned thereon at which time the panel is rotated again to face outwardly. By extending the length of the horizontal members 56, top and bottom members 66, 68 of cross member 24, catwalks 26 may be positioned sufficiently distant from the sign faces to allow them to so rotate. See FIG. 7. Flexible vinyl sheets may also be superimposed on panels 12 in taught condition by use of conventional ratchet snap such as illustrated in FIG. 20. Other technologies may also be used as above mentioned.

The present inventions provides a new and improved highway sign and billboard. The new and improved highway sign and billboard construction is fully enclosed providing no bird, rodent and insect nesting areas. The signs can be serviced by service personnel completely isolated from weather conditions such that a sign can be maintained all year long. The new and improved highway sign and billboard advertising structure of the invention may have changeable sign faces and incorporate all of the new technology. The changing of sign faces and other maintenance may be accomplished from an enclosed area whereby health concerns of service personnel will be greatly reduced.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A new and improved highway sign comprising a vertical post, a sign face support structure secured to said vertical post, a scaffold secured to said sign face support structure, a sign face mounted on said sign face support structure, said scaffold being spaced from said sign face inwardly of said sign face, a housing encompassing the entire sign face support structure, said housing having at least one opening therein through which said sign face may be viewed, said housing being environmentally sealed to the periphery of said sign face to exclude birds, rodents and insects from an enclosed space behind said sign face defined by said housing, said enclosed space having a roof and a floor.

2. The highway sign of claim 1 wherein a plurality of spaced apart sign faces are secured to said sign face support structure.

3. The highway sign of claim 2 wherein a scaffold is provided for each of said sign faces.

4. The highway sign of claim 1 wherein said scaffold comprises a catwalk adjacent the bottom of said sign face, and a catwalk mediate of said sign face, said catwalks extending the entire length of said sign face.

5. The highway sign of claim 2 wherein said sign faces face in different directions.

6. The highway sign of claim 2 wherein said sign faces face in the same direction.

7. The highway sign of claim 1 wherein said support structure includes a torsion bar secured to said post, said torsion bar extending generally horizontally, and at least one cross member secured to said torsion bar.

8. The highway sign of claim 7 wherein said cross member supports said scaffold and said sign face.

9. The highway sign of claim 7 wherein said cross member has a top member supporting said roof, a bottom member supporting said floor, side members supporting said sign faces and intermediate members extending from said torsion bar to said top and bottom and side members on which said scaffold is supported.

10. The highway sign of claim 9 wherein said intermediate members extend radially of said torsion bar.

11. The highway sign of claim 2 wherein said housing includes panels secured to said top and bottom and side members, said panels being environmentally sealed to each other and to said sign faces.

12. The highway sign of claim 3 wherein said scaffolds are spaced from said sign faces a sufficient distance to allow said sign faces to be changed from within said housing.

13. The highway sign of claim 2 wherein said housing is triangular shaped with said sign faces being faced in different directions and being angularly disposed.

14. The highway sign of claim 2 wherein said housing is generally rectangular in shape with said sign faces facing in opposite directions and being generally parallel to each other.

15. A new and improved highway sign comprising a vertical post, a sign face support structure secured to said vertical post, a scaffold secured to said sign face support structure, a sign face mounted on said sign face support structure, said scaffold being spaced from said sign face inwardly of said sign face, a housing encompassing the entire sign face support structure, said housing having at least one opening therein through which said sign face may be viewed, said housing being environmentally sealed to exclude birds, rodents and insects from an enclosed space behind said sign face defined by said housing, said enclosed space having a roof and a floor, a plurality of spaced apart sign faces being secured to said sign face support structure, a scaffold being provided for each of said sign faces, each said scaffold comprising a catwalk adjacent the bottom of said sign face, and a catwalk mediate of said sign face, said catwalks extending the entire length of said sign face.

16. A new and improved highway sign comprising a vertical post, a sign face support structure secured to said vertical post, a scaffold secured to said sign face support structure, a sign face mounted on said sign face support structure, said scaffold being spaced from said sign face inwardly of said sign face, a housing encompassing the entire sign face support structure, said housing having at least one opening therein through which said sign face may be viewed, said housing being environmentally sealed to exclude birds, rodents and insects from an enclosed space behind said sign face defined by said housing, said enclosed space having a roof and a floor, a plurality of spaced apart sign faces being secured to said sign face support structure, a scaffold being provided for each of said sign faces, each said scaffold comprising a catwalk adjacent the bottom of said sign face, and a catwalk mediate of said sign face, said catwalks extending the entire length of said sign face, said support structure including a torsion bar secured to said post, said torsion bar extending generally horizontally, and at least one cross member secured to said torsion bar, said cross member supporting said scaffold and said sign face.

17. A new and improved highway sign comprising a vertical post, a sign face support structure secured to said vertical post, a scaffold secured to said sign face support structure, a sign face mounted on said sign face support structure, said scaffold being spaced from said sign face inwardly of said sign face, a housing encompassing the entire sign face support structure, said housing having at least one opening therein through which said sign face may be viewed, said housing being environmentally sealed to exclude birds, rodents and insects from an enclosed space behind said sign face defined by said housing, said enclosed space having a roof and a floor, a plurality of spaced apart sign faces being secured to said sign face support structure, a scaffold being provided for each of said sign faces, each said scaffold comprising a catwalk adjacent the bottom of said sign face, and a catwalk mediate of said sign face, said catwalks extending the entire length of said sign face, said support structure including a torsion bar secured to said post, said torsion bar extending generally horizontally, and at least one cross member secured to said torsion bar, said cross member supporting said scaffold and said sign face, said scaffolds being spaced from said sign faces a sufficient distance to allow said sign faces to be changed from within said housing.

18. A new and improved highway sign comprising a vertical post, a sign face support structure secured to said vertical post, a scaffold secured to said sign face support structure, a sign face mounted on said sign face support structure, said scaffold being spaced from said sign face inwardly of said sign face, a housing encompassing the entire sign face support structure, said housing having at least one opening therein through which said sign face may be viewed, said housing being environmentally sealed to exclude birds, rodents and insects from an enclosed space behind said sign face defined by said housing, said enclosed space having a roof and a floor, a plurality of spaced apart sign faces being secured to said sign face support structure, a scaffold being provided for each of said sign faces, each said scaffold comprising a catwalk adjacent the bottom of said sign face, and a catwalk mediate of said sign face, said catwalks extending the entire length of said sign face, said support structure including a torsion bar secured to said post, said torsion bar extending generally horizontally, and at least one cross member secured to said torsion bar, said cross member supporting said scaffold and said sign face, said scaffolds being spaced from said sign faces a sufficient distance to allow said sign faces to be changed from within said housing, said housing being triangular shaped with said sign faces being faced in different directions and being angularly disposed.

19. A new and improved highway sign comprising a vertical post, a sign face support structure secured to said vertical post, a scaffold secured to said sign face support structure, a sign face mounted on said sign face support structure, said scaffold being spaced from said sign face inwardly of said sign face, a housing encompassing the entire sign face support structure, said housing having at least one opening therein through which said sign face may be viewed, said housing being environmentally sealed to exclude birds, rodents and insects from an enclosed space behind said sign face defined by said housing, said enclosed space having a roof and a floor, a plurality of spaced apart sign faces being secured to said sign face support structure, a scaffold being provided for each of said sign faces, each said scaffold comprising a catwalk adjacent the bottom of said sign face, and a catwalk mediate of said sign face, said catwalks extending the entire length of said sign face, said support structure including a torsion bar secured to said post, said torsion bar extending generally horizontally, and at least one cross member secured to said torsion bar, said cross member supporting said scaffold and said sign face, said scaffolds being spaced from said sign faces a sufficient distance to allow said sign faces to be changed from within said housing, said housing being generally rectangular in shape with said sign faces facing in different directions and being generally parallel to each other.

20. A fully enclosed construction for displaying one or more signs, said construction comprising: a vertical support post having a top and bottom, at least one sign support structure mounted to said post, at least one sign bearing advertising vertically and removably mounted to said sign support structure, each said sign having a front side and a back side, and a housing, said support structure having means for allowing said advertising to be changed from within said housing, said housing an enclosure totally encompassing said support structure and each said sign, said housing having an opening therein for each of said at least one sign through which said at least one sign is viewed from outside said housing.

21. The construction of claim 20 wherein said sign support structure comprises: a horizontal torsion member secured to said top of said post at a point approximately equidistant from opposite ends of said torsion member, and at least one structural brace mounted on said torsion member, each said brace having means for vertically and removably mounting each said sign.

22. The construction of claim 21 wherein each said brace further comprises: a cross member having a hub, first and second horizontal members, first and second vertical members, a top member, a bottom member, and first and second vertical support pieces each having an upper and lower end, said hub having an opening extending horizontally therethrough configured for receiving said horizontal torsion member, said first vertical member extending radially upwardly from said hub, said second vertical member extending radially downwardly from said hub, said first and second horizontal members extending radially outwardly from directly opposite horizontal sides of said hub, said top member having opposite ends and being secured to said first vertical member at an end of said first vertical member opposite said hub, said top member also being generally in the same plane as said first and second horizontal members, said bottom member being secured to said second vertical member at an end of said second vertical member opposite said hub, said bottom member also being generally in the same plane as said top member and said first and second horizontal members, said first vertical support piece being secured to an end of said first horizontal member opposite said hub at a point approximately midway between said upper and lower ends of said first vertical support piece, and said second vertical support piece being secured to an end of said second horizontal member opposite said hub at a point approximately midway between said upper and lower ends of said second vertical support piece.

23. The construction of claim 22 wherein said means includes: first and second catwalks, said first catwalk being supported by each said first horizontal member, said second catwalk being supported by each said second horizontal member.

24. The construction of claim 22 wherein said means includes at least one catwalk being supported by each said bottom member.

25. The construction of claim 22 having a first said brace mounted on said torsion member at one of said opposite ends thereof and a second said brace mounted on said torsion member at the other of said opposite ends thereof, said means include a first catwalk extending between said first horizontal member of each of said first and second braces, a second catwalk extending between said second horizontal member of each of said first and second braces, a third catwalk extending between each said bottom member of each of said first and second braces on one side of said second vertical member, and a fourth catwalk extending between each said bottom member of each of said first and second braces on another side of said second vertical member.

26. The construction of claim 25 wherein said first and second catwalks comprise an upper catwalk level and said third and fourth catwalks comprise a lower catwalk level, and said construction further comprising at least one ladder assembly connecting said upper level to said lower level.

27. The construction of claim 20 further comprising: a light and trim assembly secured to said at least one sign support structure and angularly directed towards said front side for illuminating said front side.

28. The construction of claim 22 further comprising: at least one light and trim assembly secured to said top member of each said brace at each of said opposite ends of said top member.

29. The construction of claim 20 wherein each said sign is mounted to said sign support structure by a plurality of spaced apart stringers secured to said back side of said sign, and a corresponding mounting lip for each said stringer, each said mounting lip being secured to said sign support structure.

30. The construction of claim 22 further comprising: a plurality of spaced apart mounting lips secured to a side of each of said first and second vertical support pieces opposite said hub and a plurality of spaced apart stringers secured to said back side of each said sign, each said stringer corresponding to one of said mounting lips, wherein said sign is mounted to said sign support structure by positioning each said stringer with one of said mounting lips corresponding to said stringer.

31. The construction of claim 21 wherein said horizontal torsion member comprises: a tube having opposite ends, said tube being secured to said top of said post by a horizontal mounting plate and at least one vertical tube support, said mounting plate being secured to said top of said post, each said tube support having an opening extending therethrough for receiving said tube, each said tube support being secured to said mounting plate.

32. The construction of claim 31 wherein at least one of said tube supports comprises a flat, geometric plate having a hole therethrough configured for receiving said tube.

33. The construction of claim 31 wherein at least one of said tube supports comprises a U-bolt positioned over said tube and secured to said mounting plate on opposite sides of said tube.

34. The construction of claim 20 wherein said housing comprises: a plurality of panels, each said panel having peripheral edges, each said edge of each said panel being joined by a joint to one of said edges of another of said panels, wherein said panels being joined to form the enclosure totally encompassing said support structure and each said sign.

35. The construction of claim 34 wherein said enclosure is sealed sufficiently to isolate said enclosure from environmental elements.

36. The construction of claim 35 wherein said environmental elements comprise at least one of the group consisting of weather conditions, animals and insects.

37. The construction of claim 34 wherein at least one of said joints comprises: a rubber seal, a T-shaped plate, and a plurality of tack-welded studs, said rubber seal being configured on one side thereof to receive one of said edges of one of said panels, said rubber seal being configured on another side thereof to receive one of said edges of another of said panels, said rubber seal also having a plurality of slots for receiving said tack-welded studs, said tack-welded studs being linearly positioned on one side of each of said one and said other panels adjacent said edges, and having threaded means for securing said studs to said T-shaped plate, said T-shaped plate having a plurality of openings positioned and configured for receiving said tack-welded studs; wherein said edges are received by said rubber seal and fixed in relation to each other by securing and tightening each of said tack- welded studs to said T-shaped plate using said threaded means.

38. The construction of claim 34 wherein at least one of said joints comprises: a rubber seal having a plurality of openings, a crimped boundary at each said edge of each said panel being joined, each said crimped boundary having a plurality of openings, each said opening in said crimped boundary being configured to receive a fastening bolt, and a plurality of fastening bolts, said rubber seal being positioned between each of said crimped boundaries, said rubber seal and each said crimped boundary being aligned in order to have one of said openings in one of said crimped boundaries corresponding to one of said openings in another of said crimped boundaries of an adjacent panel, and corresponding to one of said openings in said rubber seal; wherein said rubber seal is fastened between said, one and another crimped boundaries by inserting and securing one of said fastening bolts through said aligned openings in said rubber seal and said one and another of said crimped boundaries.

* * * * *